United States Patent [19]

Hucke

[11] 4,164,254

[45] Aug. 14, 1979

[54] HEAT EXCHANGE DEVICE

[76] Inventor: Hans Hucke, Essigweg 6, CH-4133 Prätteln-Basel, Switzerland

[21] Appl. No.: 803,285

[22] Filed: Jun. 3, 1977

[30] Foreign Application Priority Data

Jun. 8, 1976 [DE] Fed. Rep. of Germany ... 7618150[U]

[51] Int. Cl.[2] ..... F25B 29/00

[52] U.S. Cl. ..... 165/65; 165/143

[58] Field of Search ..... 165/143, 61, 65, 66

[56] References Cited

U.S. PATENT DOCUMENTS

| | | | |
|---|---|---|---|
| 2,004,391 | 6/1935 | Price et al. | 165/143 X |
| 2,236,470 | 3/1941 | De Jonge | 165/65 X |
| 2,243,593 | 5/1941 | Zallea | 165/143 X |
| 2,787,134 | 4/1957 | Boling | 165/143 X |
| 4,002,198 | 1/1977 | Wagner et al. | 165/61 |

*Primary Examiner*—Albert W. Davis, Jr.
*Assistant Examiner*—Margaret A. Focarino
*Attorney, Agent, or Firm*—Haseltine, Lake & Waters

[57] ABSTRACT

A heat exchange device for a heat transmission apparatus utilizing a heat carrier liquid, comprising a U-shaped tube provided with an inlet at one end and with an outlet at the other end thereof for the passage of the heat carrier liquid; a tubular casing extending into each arm of the U-shaped tube, which casing is closed at one end to prevent heat carrier liquid entering the casing and which forms an annular flow passage between the casing and the arm of the tube; and heat transfer means disposed within each casing for regulating the temperature of the heat carrier liquid flowing through the annular flow passage.

7 Claims, 3 Drawing Figures

HEAT EXCHANGE DEVICE

FIELD OF THE INVENTION

This invention relates to a heat exchange device for a heat transmission apparatus operating with forced circulation of a liquid heat carrier.

DESCRIPTION OF THE PRIOR ART

Heretofore it has been necessary in heat transmission apparatus for a separate cooling device for the circulating liquid to be installed in cases where cooling is to take place instead of heating.

OBJECT OF THE INVENTION

It is an object of the present invention to provide a heat exchange device in which it is not necessary for a separate cooling device for the circulating liquid to be installed in cases where cooling is to take place instead of heating.

It is a further object of the present invention to incorporate in the heat exchange device prefabricated modular parts in order to rationalize manufacture.

SUMMARY OF THE INVENTION

According to the present invention there is provided a heat exchange device for a heat transmission apparatus utilizing a heat carrier liquid, the heat exchange device comprising:

- a U-shaped tube provided with an inlet at one end and with an outlet at the other end thereof for the passage of the heat carrier liquid;
- a tubular casing extending into each arm of the U-shaped tube, which casing is closed at one end to prevent heat carrier liquid entering the casing and which forms an annular flow passage between the casing and the arm of the tube; and
- heat transfer means disposed within each casing for regulating the temperature of the heat carrier liquid flowing through the annular flow passage.

Preferably, the heat transfer means is replaceably mounted in each tubular casing.

The heat transfer means may comprise at least one heating means or it may comprise at least one cooling means.

The cooling means may comprise an open ended tube inserted into the tubular casing to form an annular gap between the tube and the casing, the tubular casing being formed with an inlet and an outlet for the passage of a cooling fluid such that the cooling fluid flowing through the annular gap flows countercurrently to the heat carrier liquid flowing through the adjacent annular flow passage.

The heat exchange device may include a plurality of U-shaped tubes, the outlet of one U-shaped tube being connected to the inlet of the next u-shaped tube.

Preferably, the tubular casings are substantially the same as one another.

For a better understanding of the present invention and to show more clearly how the same may be carried into effect, reference will now be made, by way of example, to the accompanying drawings, in which:

DESCRIPTION OF PREFERRED EMBODIMENT

Figure 1:
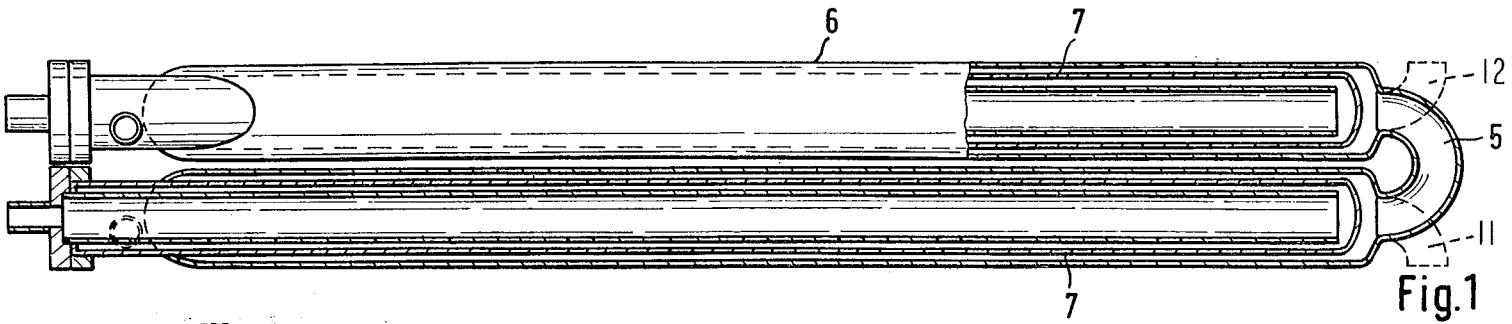
FIG. 1 is a side elevation of two interconnected U-shaped tube units of a throughflow element according to the present invention.

The drawings show a heat exchange device which is made up from a number of substantially similar U-shaped tubes 1 and 2. The two tubes 1 and 2 shown in the drawings are disposed one above the other. The outlet 12 of one arm 3 of tube 1 is connected to the inlet 11 of that arm 4 of tube 2 which is immediately below arm 3 by means of a curved section pipe 5, the cross-sectional area of pipe 5 being less than the cross-sectional area of tubes 1 and 2. The other arm of tube 1 and the other arm of tube 2 are connected to an inlet or an outlet for a heat carrier liquid.

Extending into each arm of the pipes is a tubular casing 7. The casing is closed at the end of the tubes 1 and 2 which is nearest pipe 5 and is spaced from the inner surface of the wall 6 of the tube to form an annular flow passage for the heat carrier liquid between the casing and the tube.

The end of each tubular casing 7 which is remote from the end nearest pipe 5 projects out of the arm of tube 1 or 2 and is also closed.

Figure 2:
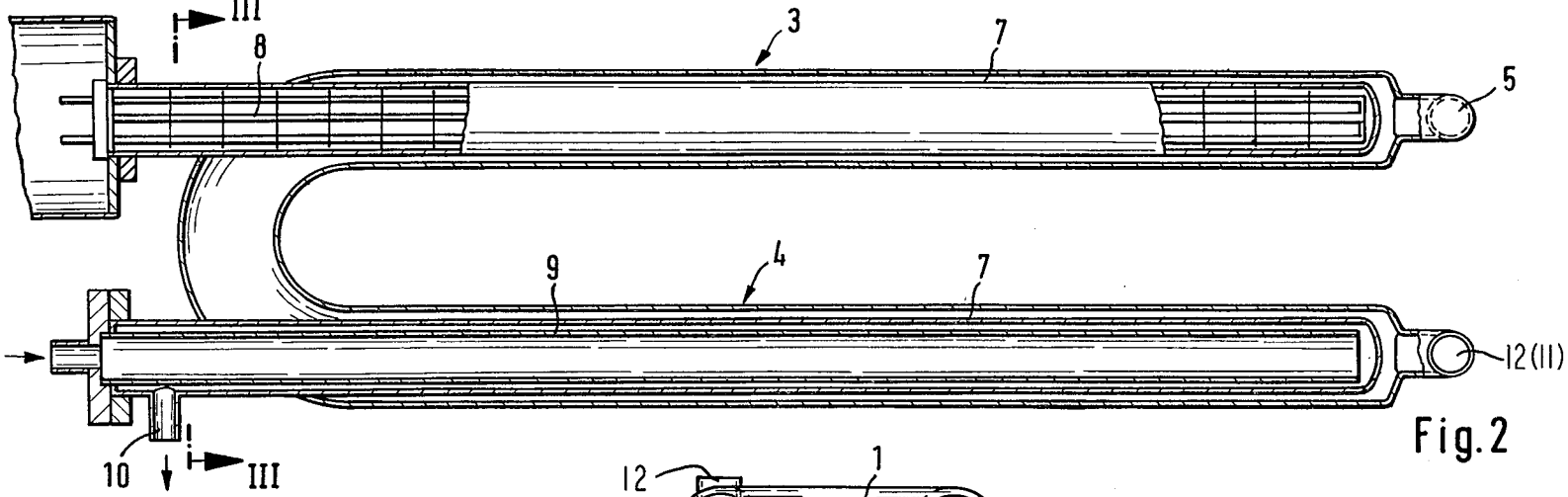
FIG. 2 is a plan view of the throughflow element shown in FIG. 1.
Figure 3:
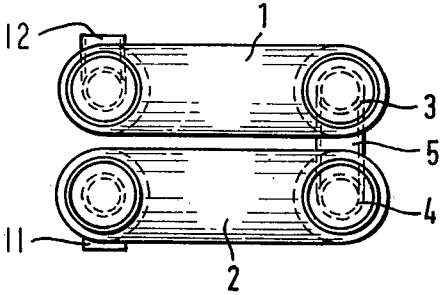
FIG. 3 is a section along the line III—III in FIG. 2.

As shown in FIG. 2, there is disposed in the tubular casing of one arm of the U-shaped tube a replaceable heating element 8, such as an electrical heating element, and in the casing 7 of the other arm there is arranged a replaceable open ended tube 9 which forms an annular flow passage between the tube 9 and the casing 7.

In use, heat carrier liquid flows through the tubes 1 and 2 and the pipe 5 from the inlet to the outlet thereof. If it is desired to heat the heat carrier liquid, then heat is supplied from the heating element 8 to the heat carrier liquid flowing through the annular gap between the casing 7 containing heating element 8 and the wall 6 of tubes 1 and 2. On the other hand, if it is desired to cool the heat carrier liquid then cooling liquid is passed into the tube 9 and flows around the open end of the tube and into the annular flow passage between the tube 9 and the casing 7. Is is preferable if the cooling liquid flows in the annular passage in countercurrent to the heat carrier liquid which is flowing on the other side of the casing 7. The cooling liquid then flows away through a discharge branch 10 of the casing 7.

I claim:

1. A heat exchange device for a heat transmission apparatus utilizing a heat carrier liquid, the heat exchange device comprising: a U-shaped tube provided with an inlet at one end and with an outlet at the other end thereof for the passage of the heat carrier liquid; a tubular casing extending into each arm of the U-shaped tube, said casing being closed at one end to prevent heat carrier liquid entering the casing and forming an annular flow passage between the casing and the arm of the tube; and a heat transfer means replaceably mounted within each casing for selective heating up or cooling off the heat carrier liquid flowing through the annular flow passage, wherein the heat transfer means is mounted from the U-side of the U-shaped tube in each tubular casing.

2. A heat exchange device according to claim 1, wherein the heat transfer means comprises at least one heating means.

3. A heat exchange device according to claim 1, wherein the heat transfer means comprises at least one cooling means.

4. A heat exchange device according to claim 1, wherein the cooling means comprises an open ended tube inserted into the tubular casing to form an annular gap between the tube and the casing, the tubular casing being formed with an inlet and an outlet for the passage of a cooling fluid such that the cooling fluid flowing through the annular gap flows counter currently to the heat carrier liquid flowing through the adjacent annular flow passage.

5. A heat exchange device according to claim 1 and including a plurality of U-shaped tubes which are assembled by a building block system by connecting the outlet of one U-shaped tube to the inlet of the next U-shaped tube.

6. A heat exchange device according to claim 1, wherein the tubular casings are substantially the same as one another.

7. A heat exchange device according to claim 1 wherein said heat carrier liquid is substantially continually heated at one location and is substantially continuously cooled at another location.

* * * * *